United States Patent [19]

Miscioscio et al.

[11] 4,392,921

[45] Jul. 12, 1983

[54] COMPOSITION AND PROCESS FOR ELECTROPLATING WHITE PALLADIUM

[75] Inventors: Kathleen B. Miscioscio, Bayside, N.Y.; Paul T. Smith, Pascoag, R.I.

[73] Assignee: Occidental Chemical Corporation, Warren, Mich.

[21] Appl. No.: 217,318

[22] Filed: Dec. 17, 1980

[51] Int. Cl.[3] ..... C25D 3/50

[52] U.S. Cl. ..... 204/47

[58] Field of Search ..... 204/47, 43 N

[56] References Cited

U.S. PATENT DOCUMENTS

| | | | |
|---|---|---|---|
| 3,150,065 | 9/1964 | Fatzer | 204/47 |
| 3,458,409 | 7/1969 | Hayashi et al. | 204/43 N |
| 3,580,820 | 5/1971 | Yamamura et al. | 204/43 N |
| 3,677,909 | 7/1972 | Yamamura et al. | 204/43 N |
| 3,920,526 | 11/1975 | Caricchio et al. | 204/47 |
| 3,925,170 | 12/1975 | Skomoroski et al. | 204/43 N |
| 3,972,787 | 8/1976 | Nobel et al. | 204/47 |
| 4,066,517 | 1/1978 | Stevens et al. | 204/43 N |
| 4,076,599 | 2/1978 | Caricchio et al. | 204/47 |
| 4,098,656 | 7/1978 | Deuber | 204/47 |
| 4,297,177 | 10/1981 | Fletcher et al. | 204/43 N |

FOREIGN PATENT DOCUMENTS

| | | | |
|---|---|---|---|
| 1035850 | 7/1966 | United Kingdom | 204/47 |

OTHER PUBLICATIONS

G. J. Saxenmeyer et al., IBM Tech. Disclosure Bulletin, vol. 19, No. 5, p. 1672, Oct. 1976.

*Primary Examiner*—G. L. Kaplan

*Attorney, Agent, or Firm*—Richard P. Mueller

[57] ABSTRACT

Electroplating baths suitable for obtaining white deposits of palladium metal. The bath comprises diaminodinitrite, an ammonium salt, and a sufficient amount of ammonium hydroxide to obtain a bath pH of about 9. Buffers such as ammonium biborate may be employed to maintain the necessary bath pH during electroplating operations to produce a thin, white deposit of palladium metal. The process of using such electroplating baths to produce white deposits of palladium metal on substrates is also disclosed and claimed.

2 Claims, 1 Drawing Figure

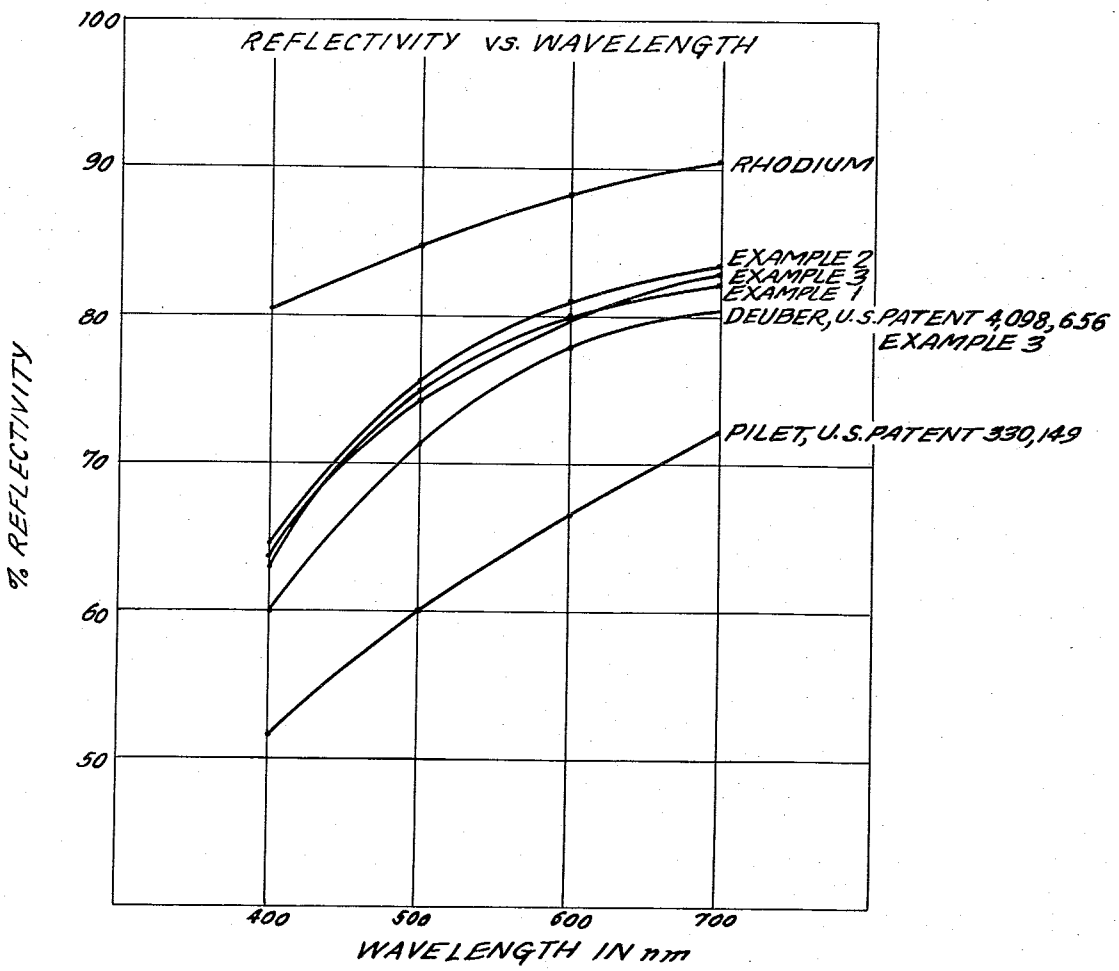
REFLECTIVITY VS. WAVELENGTH
RHODIUM
EXAMPLE 2
EXAMPLE 3
EXAMPLE 1
DEUBER, U.S. PATENT 4,098,656
EXAMPLE 3
PILET, U.S. PATENT 330,149
100
90
80
70
60
50
% REFLECTIVITY
400
500
600
700
WAVELENGTH IN nm

COMPOSITION AND PROCESS FOR ELECTROPLATING WHITE PALLADIUM

BACKGROUND OF THE INVENTION

The present invention relates to an electroplating bath for the deposition of white palladium metal on various surfaces. More particularly, the invention is concerned with baths for producing thin deposits of white palladium metal.

As is known in the art, the use of conventional palladium baths produces deposits which are grey in color. There are rhodium baths, on the other hand, known to produce white deposits which are very useful in the decorative art industries. In view of the relatively high cost of rhodium as compared to palladium, it would be desirable to be able to obtain a white finish from palladium baths as a substitute for the rhodium finishes now being employed. Previous attempts to produce a white palladium metal deposit were unsuccessful because the deposit was not white enough for the intended purposes, e.g., as a substitute for the conventional white rhodium deposits. It would also be useful for commercial purposes to be able to obtain readily thin, white deposits of palladium metal.

U.S. Pat. No. 330,149 which issued to Pilet et al. 1885, does mention the production of a "white palladium deposit". The electroplating bath of Pitel et al. contained palladium chloride, ammonium phosphate, sodium phosphate or ammonia, and, optionally, benzoic acid. The operating pH of the bath is not disclosed, although it is stated that ammonia is "boiled" off and "the liquid which was alkaline, becomes slightly acid". As indicated, the use of benzoic acid is disclosed to be optional, but the patentees disclose that it bleaches the deposit and makes the deposit more striking on iron and steel.

Electroplating baths designed to improve the brightness of palladium or palladium alloy deposits on metal substrates are also known in the art. See, for example, U.S. Pat. No. 4,098,656, which issued to Deuber in 1978. In this patent the improved brightness is achieved by utilizing in the bath both a Class I and a Class II organic brightener and an adjusted pH range of from 4.5 to 12.

In the drawings, the single FIGURE is a graph which illustrates the whiteness of the palladium deposits of the present invention as compared to those of the prior art.

SUMMARY OF THE INVENTION

In accordance with the present invention it has now been discovered that thin white palladium metal deposits can be readily obtained from an electroplating bath formed from a bath soluble source of palladium and an ammonium salt, where the pH is within the range of about 8 to 10. The use of a phosphate matrix is preferred, since it results in superior whiteness. However, it should be understood that ammonium sulfate, for example, also gives acceptable results.

A further essential feature of the present invention is the need to have ammonium ions present in the system as part of the conductive salt and to use them as well for adjusting the pH, preferably raising the pH to about 9. It was found that if the bath contained disodium phosphate instead of the ammonium phosphate, the desired white deposit was not attained. Unsatisfactory results were also obtained when the pH was adjusted with either sodium hydroxide or potassium hydroxide. It should be understood, however, that the presence of sodium ions does not have a detrimental effect on the deposit, since sodium tetraborate is an acceptable buffer for the system.

DETAILED DESCRIPTION OF THE INVENTION

The bath soluble source of the palladium metal in the electroplating bath of this invention may be any palladium amine complex, such as the nitrate, nitrite, chloride, sufate and sulfite complexes. Typical of such complexes which may be used are palladium diaminodinitrite and palladosamine chloride, with palladium diaminodinitrite being preferred. The palladium content of the plating bath will be at least sufficient to deposit palladium on the substrate when the bath is electrolyzed but less than that which will cause darkening of the deposit. Typically, the palladium concentration will be about 0.1 to 20 grams/liter, with concentrations of about 1 to 6 grams/liter being preferred.

The conductive salt may be any bath soluble ammonium-containing inorganic salt, such as dibasic ammonium phosphate, ammonium sulfate, ammonium chloride, and the like. Mixtures of such salts may also be utilized. The amount of the ammonium salt in the plating bath will be at least that which will provide sufficient conductivity to the bath to effect the palladium electrodeposition, up to the maximum solubility of the salt in the bath. Typically, the ammonia conducting salt will be present in an amount of about 30 to 120 grams/-liter, with amounts of about 50 to 100 grams/liter being preferred.

As discussed above, the third essential material employed in formulating the electroplating bath of this invention is ammonium hydroxide. This compound is used in an amount sufficient to raise the pH of the bath to the desired range, i.e. about 8 to 10 and preferably about 9 to 9.5. In general, the ammonium hydroxide is employed in amounts ranging from about 10 to 50 ml per liter of the plating bath.

Buffers such as ammonium biborate, sodium tetraborate, trisodium phosphate, and the like may be employed to ensure that the desired pH is maintained in the plating bath during plating. The amount of the buffering agent or agents employed in the plating bath may range from about 0 to 50 g/l, and preferably about 10 to 30 g/l.

The temperature of the palladium plating bath may be maintained between room temperature and 160° F. In order to avoid the emission of excess ammonia from the solution, the plating temperature will be preferably below about 130° F. For many purposes operations at room temperature are preferred. Current densities from about 0.1 to 50 ASF (i.e., about 0.01 to 5 Ad/dm$^2$) are suitable. In general, current densities of from 2 to 20 ASF, preferably about 10 ASF, may be employed.

A further feature of the present invention is to produce only thin deposits of palladium so as to further ensure the production of a white deposit. Thus, the deposit thickness may vary from about 0.01 to 0.5 microns, and preferably from 0.03 to 0.4 microns.

The "whiteness" characteristic of the present invention is quantified in terms of white light reflectivity measured by spectrophotometric methods such as utilizing a Perkin-Elmer 559 spectrophotometer and plating the deposits to be studied over 1 inch by 1 inch panels preplated with 0.5 mils copper and then 0.5 mils of nickel, hereinafter referred to as the nickel plated panels, to eliminate surface imperfections. The white light reflectivity of these panels is scanned in the transmittance mode from 400 to 700 nanometers against a magnesium oxide reference plate. The sample deposit scan is then compared to a similar scan of a rhodium deposit. Electroplating baths, having a pH of 9–9.5, according to the invention are as follows:

| Component | Concentration |
|---|---|
| (A) $Pd(NH_3)_2(NO_2)_2$* | 1 to 6 g/l (as Pd) |
| (B) Conducting Salt | 50 to 100 g/l |
| (C) Ammonium Hydroxide | 10 to 50 ml/l |
| (D) Buffer | 0 to 50 g/l |

*Palladium diaminodinitrite

The invention will be more fully understood from the following illustrative examples, wherein the temperatures are given in degrees centigrade.

EXAMPLE 1

A palladium electrolytic solution was prepared by dissolving the following ingredients in water:

| Component | Concentration |
|---|---|
| Palladium Diaminodinitrite | 2 g/l (as Pd) |
| Dibasic Ammonium Phosphate | 95 g/l |
| Ammonium Hydroxide | 24 ml/l |

The amount of ammonium hydroxide used in the above formulation adjusts the pH to about 9.2. Plating was performed at ambient temperature, a current density of 10 ASF for 45 seconds on a nickel plated panel, to produce a white palladium deposit having a thickness of 0.25–0.35 microns.

EXAMPLE 2

A plating bath similar to Example 1, but with the use of a buffer, was formulated as follows:

| Component | Concentration |
|---|---|
| Palladium Diaminodinitrite | 2 g/l (as Pd) |
| Dibasic Ammonium Phosphate | 96 g/l |
| Ammonium Biborate | 25 g/l |
| Ammonium Hydroxide | 24 ml/l |

The amount of ammonium hydroxide used in this formulation also adjusts the pH to about 9.2. Plating was performed at ambient temperature, a current density of 10 ASF for 45 seconds, on a nickel plated panel, to produce a white palladium deposit having a thickness of 0.25–0.35 microns. The ammonium biborate acted as a buffer to maintain the pH at the desired level.

EXAMPLE 3

A plating bath similar to that of Example 2, with the exception that sodium tetraborate was used as the buffering agent, was formulated as follows:

| Component | Concentration |
|---|---|
| Palladium Diaminodinitrite | 4 g/l (as Pd) |
| Monobasic Ammonium Phosphate | 50 g/l |
| Ammonium Hydroxide | 24 ml/l |
| Sodium Tetraborate | 25 g/l |

The aqueous solution contained sufficient ammonium hydroxide to adjust the pH to 9. The plating operations were carried out under the same conditions as Examples 1 and 2 to produce a white palladium deposit having a thickness of 0.25–0.35 microns.

In the following table the white light reflectivity of the palladium deposits on the nickel-plated panels of Examples 1 through 3 was compared with a rhodium deposit on a nickel plated panel as well as deposits made in accordance with Example 3 of the Deuber U.S. Pat. No. 4,098,656 and the Pilet U.S. Pat. No. 330,149 (page 1, lines 77–102 and page 2, lines 1–8). The Deuber and Pilet deposits had a thickness of 0.25–0.35 microns. The Perkin-Elmer spectrophotometer and the test procedure described above were employed.

TABLE 1

| DEPOSIT | % REFLECTIVITY | | | |
|---|---|---|---|---|
| | 400 nm | 500 nm | 600 nm | 700 nm |
| Rhodium | 80.5 | 85.0 | 88.5 | 90.5 |
| Deuber | 60.0 | 71.5 | 78.0 | 80.5 |
| Pilet | 51.5 | 60.0 | 66.5 | 72.0 |
| Example 1 | 63.5 | 75.0 | 80.0 | 82.5 |
| Example 2 | 64.5 | 75.5 | 81.0 | 83.5 |
| Example 3 | 63.0 | 74.5 | 80.0 | 83.0 |

The foregoing data reveal that the electroplating baths of this invention produce a significantly improved palladium metal deposit as to white light reflectivity when compared to both Deuber and Pilet. The visual difference in whiteness is so significant that for commercial applications it can be the difference between acceptance and rejection.

When the foregoing data are plotted, percentage reflectivity versus wavelength, as in the accompanying drawing, the resulting graph further reveals the significance between the results achieved by the practice of the present invention.

Scanning Electron Microscope (SEM) Micrographs were made of the deposit produced in Example 2 and those produced by the procedures of the Pilet et al and Deuber patents. These Micrographs show that the Pilet et al deposits have extensive dendritic deposits and surface roughness. The Deuber deposits, while showing somewhat reduced dendritic growth than Pilet et al, still have considerable surface roughness. In contrast, the deposit from Example 2, is very smooth with no dendritic deposits. This further illustrates the unique properties of the deposits produced by the present invention and indicates the correlation between the smoothness of the deposit and its white light reflectivity.

It will be further understood that the examples set forth above are illustrative only, and that the invention is subject to further changes and modifications within the broader aspects of the invention.

What is claimed is:

1. A stable aqueous electroplating bath suitable for obtaining thin, white deposits of palladium metal which consists essentially of a bath soluble source of pure palladium metal, free of alloying elements, which source is present in amounts sufficient to provide from about 0.1 to about 20 g/l palladium in the bath, from about 30 to about 120 g/l of a bath soluble ammonium conductivity salt, a sufficient amount of ammonium hydroxide to adjust and maintain the pH in the bath of from about 8 to 10 and a buffer selected from ammonium biborate and sodium tetraborate to maintain the pH within said range.

2. A method of depositing white deposits of palladium metal on a substrate which comprises passing an electric current through the electroplating bath of claim 1 between a cathode and an anode, for a period of time sufficient to produce a palladium electrodeposit having a thickness of from about 0.01 to 0.5 microns.

* * * * *